US006729362B2

(12) United States Patent
Scheindel

(10) Patent No.: US 6,729,362 B2
(45) Date of Patent: May 4, 2004

(54) SEALING GROMMET

(76) Inventor: Christian T. Scheindel, 2065 Ridge Rd., Randolph Center, VT (US) 05061

( * ) Notice: Subject to any disclaimer, the term of this patent is extended or adjusted under 35 U.S.C. 154(b) by 0 days.

(21) Appl. No.: 10/420,562

(22) Filed: Apr. 22, 2003

(65) Prior Publication Data

US 2004/0065381 A1 Apr. 8, 2004

Related U.S. Application Data

(63) Continuation-in-part of application No. 10/264,119, filed on Oct. 3, 2002.

(51) Int. Cl.[7] ..... B65B 31/00

(52) U.S. Cl. ..... 141/20; 141/3; 141/113; 220/203.13

(58) Field of Search ..... 141/3, 20, 113; 220/203.13

(56) References Cited

U.S. PATENT DOCUMENTS 2,543,613 A * 2/1951 Ten Eyck ..... 248/51
2,933,102 A * 4/1960 Hillman et al. ..... 137/854
4,658,979 A * 4/1987 Mietz et al. ..... 220/203.13

OTHER PUBLICATIONS

Monfort A. Johnsen, "Aerosol Technology, Compartmentalized Dispensers: Part III The Bottom Plug", Spray Technology and Marketing, Jan. 2002, pp. 22–28.

* cited by examiner

*Primary Examiner*—Gregory L. Huson
*Assistant Examiner*—Peter deVore
(74) *Attorney, Agent, or Firm*—Reed Smith LLP

(57) ABSTRACT

A grommet for sealing the propellant charging opening in a pressurized dispensing container has a crown portion inside the container, a base portion outside of the container and a resilient neck joining the base and crown. The neck dimensions are such so as to provide three interference fit sealing zones between grommet and container base. The neck has a length less than the lip of the container opening to provide a first interference fit sealing relationship. The neck diameter is greater than the diameter of the lip to provide a second interference fit sealing relationship. The corner between neck and crown is rounded to provide a third interference fit sealing relationship. The grommet has a central opening so that a stretch pin can be inserted to stretch the neck during the injection of propellant. The extended neck lifts the crown from the container and causes the neck to contract to provide a passageway around the neck and under the crown for injected propellant.

17 Claims, 5 Drawing Sheets

SEALING GROMMET

REFERENCE TO RELATED APPLICATION

This application is a continuation-in-part of patent application Ser. No. 10/264,119 filed on Oct. 3, 2002 and titled: Sealing Grommet.

BACKGROUND OF THE INVENTION

This invention relates in general to a sealing grommet and more particularly to one adapted to be used to seal the base of a pressurized dispensing container.

Pressurized dispensing containers having a piston or collapsible bag that separate pressurized propellant on the underside of the piston or outside of the bag and the material to be dispensed, through a valve, on the upper side of the piston are known in the art. One such pressurized piston operated dispensing container is described in Applicant's Pat. No. 4,913,323 dated Apr. 3, 1990.

The base of these containers has a small center opening which is used to inject propellant under pressure. The opening has to be sealed thereafter and various grommets or plugs are known to perform this sealing function.

The known grommets or plugs can be dislodged or tilted by a simple fingernail application. For whatever reason, it is known that propellant leakage sometimes occurs with the use of known grommets or plugs.

Because of increased environmental concern with the release of these propellants into the atmosphere, it is desired to provide a grommet which will effectively seal in the propellant and be resistant to the tilting movement or removal that might cause loss of propellant.

Achieving this environmentally desirable result also means a substantial decrease in the number of dispensing containers which fail to achieve targeted shelf life.

Environmental concerns arise out of the use of hydrocarbon propellants such as isobutane, propane and butane. Pressure loss problems arise when using compressed air or compressed nitrogen.

If the sealing plug is disturbed so that some propellant is lost and the propellant has a liquid reservoir, the pressure loss problem may be minor. However, if compressed gas, such a nitrogen, is lost, pressure losses are material and the product cannot all be dispensed.

This invention provides a particular grommet as a sealing plug which is kept in place so as to avoid the problem of pressure loss and also avoid the problem of environmental pollution.

Accordingly, it is the object of this invention to provide a sealing grommet for the base of these pressurized containers which will substantially and effectively reduce the risk of propellant leakage through the base opening.

It is a related object to achieve this sealing object in a grommet design which permits the injection of propellant while the grommet is in place.

BRIEF DESCRIPTION

The grommet of this invention seals the small opening in the base of a pressurized dispensing container. This container opening is used to charge propellant into the container. The grommet is made of resilient material. The grommet includes a base, a crown and a neck connecting the base and crown.

The neck of the grommet has dimensions which provide an interference fit relationship with the lip of the can opening with which the grommet is to be used. These interference fits assure that the grommet will seal the propellant in the container.

In particular, the height of the neck of the grommet, in its relaxed state, is less than the height of the lip of the can with which the grommet is to be used. In the sealing state, there is an interference fit relationship between the lip on the one hand and the gap between crown and base. The diameter of the neck in its relaxed, unassembled state, is greater than is the diameter of the container opening. When the grommet is assembled on the can, the fit between the neck and the container assures sealing between the grommet and the container opening.

The corner between the neck and the crown is rounded slightly so as to provide a highly effective sealing relationship between this internal corner of the grommet and a corner of an edge of the container opening.

The base has four through openings, through which propellant is charged into the container. In addition, the grommet has a central opening that extends through the base and into the crown. During the charging operation, a pin in the gassing head is inserted through the central opening to push the crown up off the container wall during the propellant charging operation. This causes the extendable neck to decrease in diameter and also serves to hold the crown above the edge of the lip of the container opening. In that state, the four through openings in the base are in communication with the surface of the neck and the interior of the container. Thus propellant can be injected into the lower compartment of the container.

After the propellant charging operation, the gassing head is withdrawn and the resilient neck contracts axially and expands radially bringing the grommet into its sealing state. At that point, the pressure within the container on the top of the crown further assures a tight sealing engagement between the crown and the container bottom.

DESCRIPTION OF THE PREFERRED EMBODIMENTS

Figure 1:
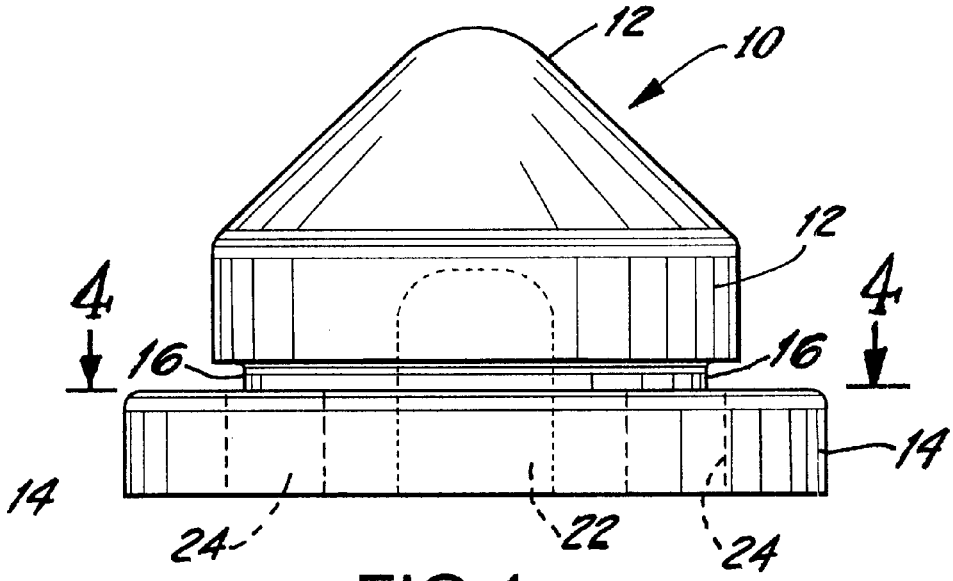
FIG. 1 is a side view of the grommet of this invention showing the crown 12 and base 14 connected by the neck 16.
Figure 2:
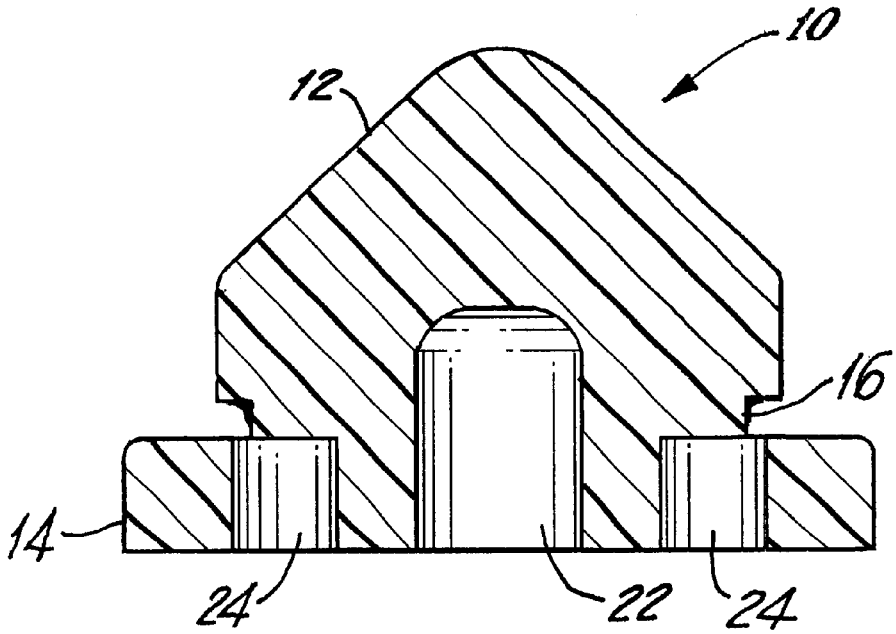
FIG. 2 is a longitudinal sectional view through the FIG. 1 grommet.
Figure 3:
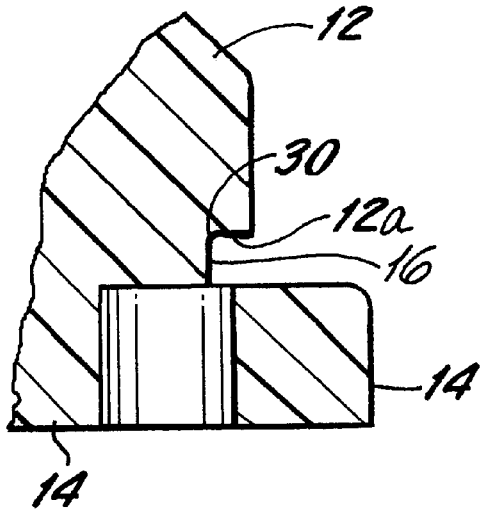
FIG. 3 is a blown up portion of FIG. 2 showing the curved corner 30 that is at the intersection of the crown 12 and neck 16.
Figure 4:
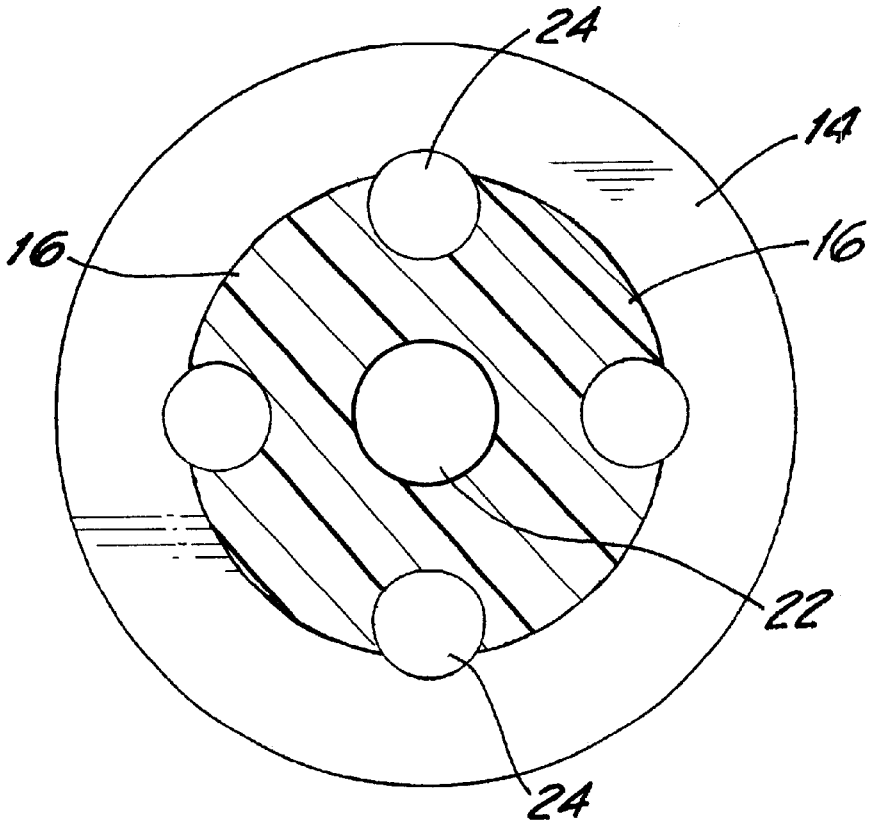
FIG. 4 is a cross-sectional view through the grommet along the plane 4—4 of FIG. 1.
Figure 5:
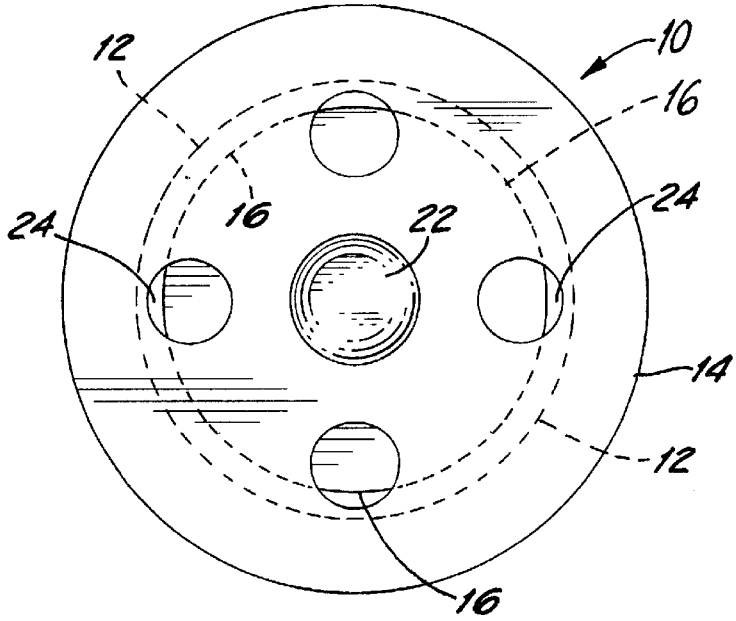
FIG. 5 is a view from the base of the FIG. 1 grommet.
Figure 6:
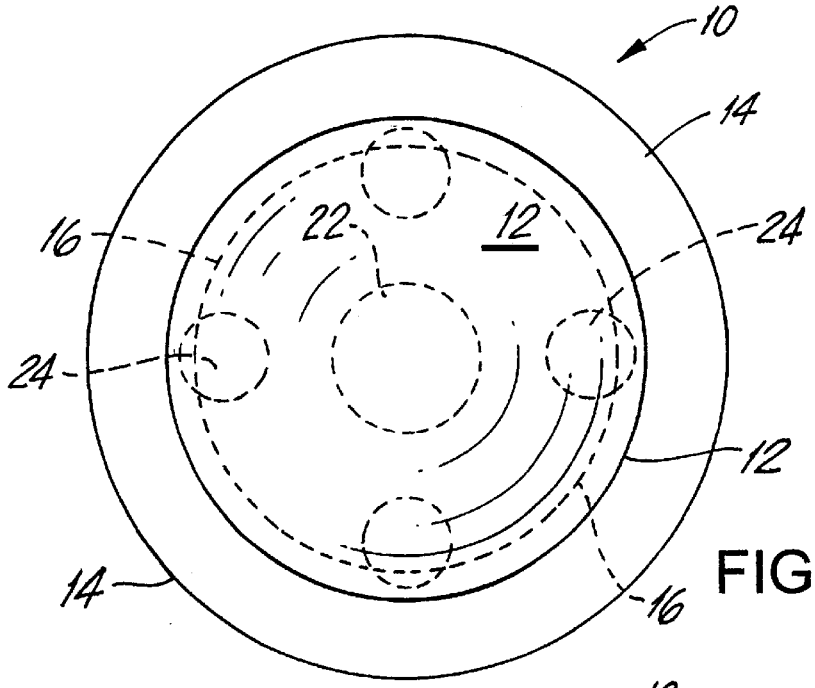
FIG. 6 is a view from the top of the FIG. 1 grommet.

The FIGs. exemplify a single embodiment of this invention. The grommet 10 has a crown 12, a base 14 and an intermediate neck 16 which connects the crown 12 to the base 14.

FIGS. 1 through 7 illustrate the grommet 10 of this invention in its assembled relaxed state. The significant operation of the grommet 10 is best understood from FIGS. 8 and 9 which shows it assembled in the FIG. 7 base opening 18.

As shown in FIGS. 1 through 6, the grommet 10 has a crown 12 and a base 14 which are connected by a short neck 16. The neck 16 fits within the opening 18 of the can base 20 (see FIG. 7) when the grommet 10 is mounted on the can as shown in FIG. 8.

The base 14 has four through openings 24 whose primary function is to permit charging fluid to be inserted into the can through the grommet when the grommet is assembled on the base 20 of a dispensing container. The openings 24 extends through the base 14 to the extent that at least a portion of the openings 24 are in communication with the neck 16. This is so that during the charging state shown in FIG. 9, there will be communication through the openings 24 to the interior of the container on which the grommet 18 is mounted.

In addition to these openings 24, there is a non-through opening 22 which extends through the base and neck and into the crown. A major function of this opening 22 is to facilitate stretching the neck 16 during the charging state shown in FIG. 9, so that the crown 12 will be lifted off of the base 20 of the container with which the grommet is to be employed.

Figure 7:
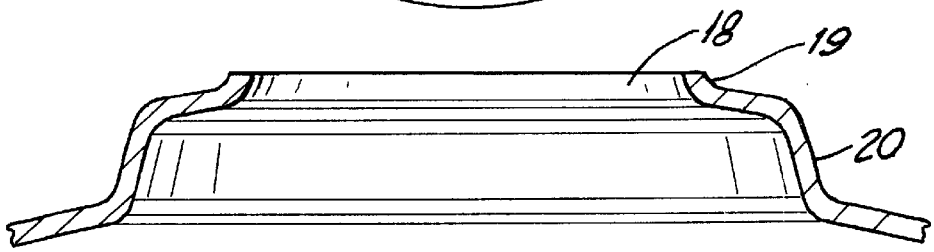
FIG. 7 is a sectional view through the zone of the base 20 of the container with which the grommet of FIG. 1 is to be used showing the opening 18 into which the FIG. 1 grommet is to be inserted.
Figure 8:
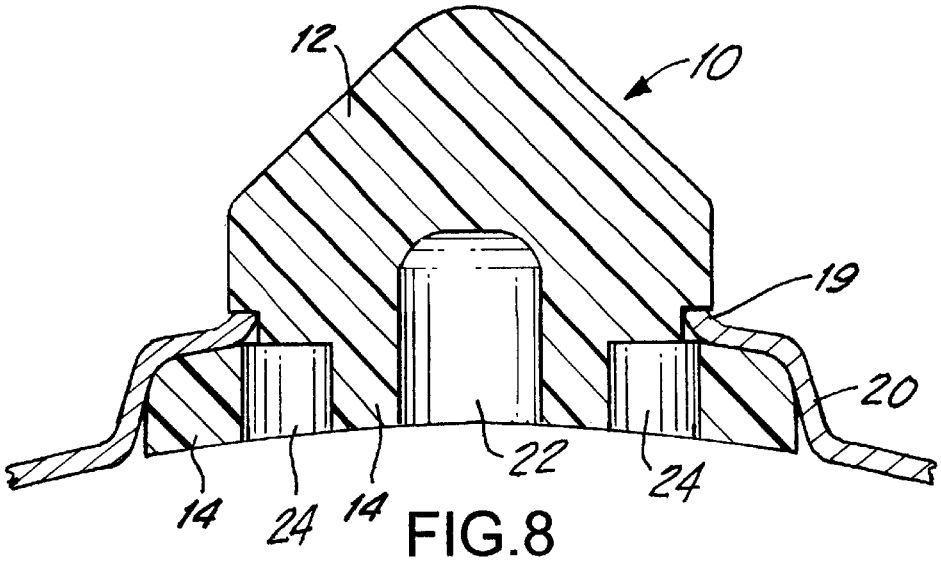
FIG. 8 is a sectional view showing the FIG. 1 grommet assembled into the FIG. 7 can base in the sealing state.

FIG. 7 shows a portion of a typical container bottom with which the grommet 10 is to be employed. The container bottom has a wall 20 that includes an opening 18 through which pressurized charging fluid is to be charged into the container. This wall 20 terminates in a lip 19. The grommet 10 is assembled on the opening 18 of the container wall 20 to provide the sealing state shown in FIG. 8 and the charging state shown in FIG. 9.

Figure 9:
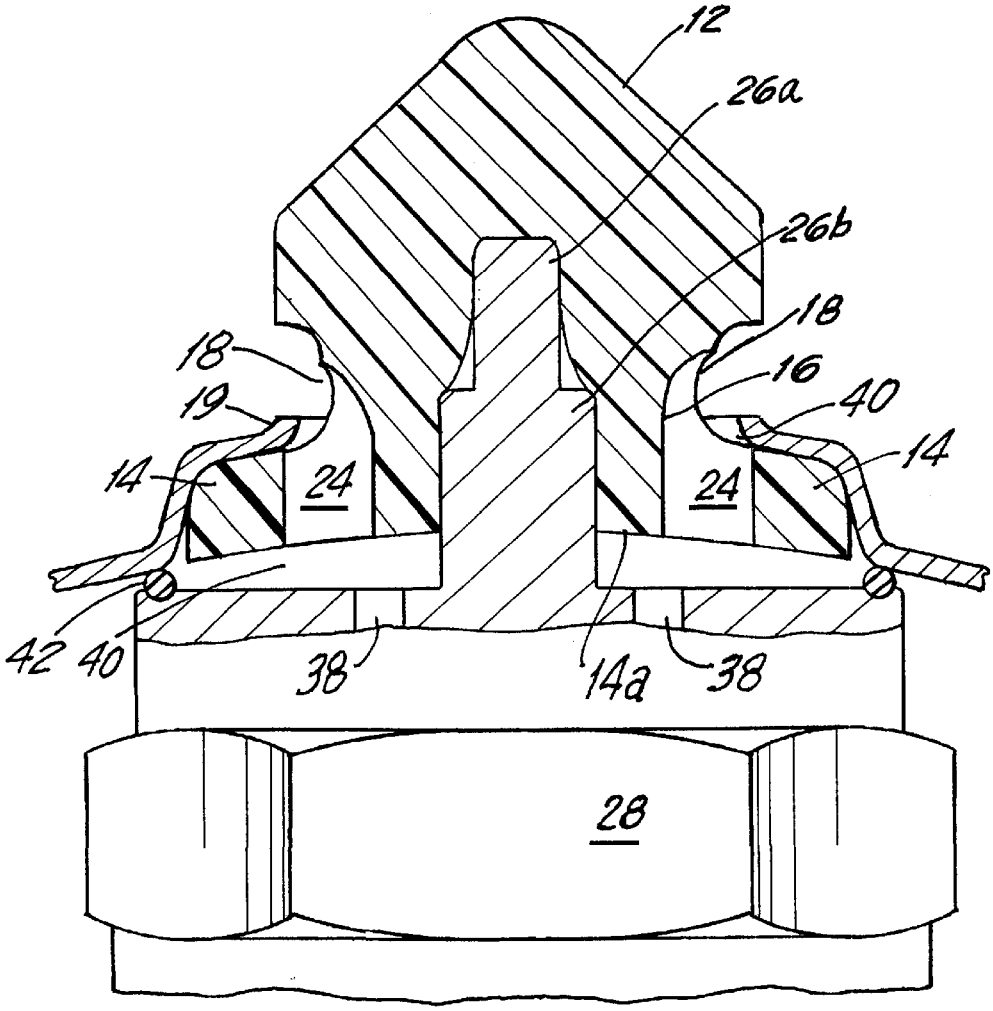
FIG. 9 is a sectional view somewhat similar to FIG. 8 in which the grommet in place on the can has been mounted on a gassing head 28 which stretches the grommet into its charging state.

FIGs. 8 and 9 show, respectively, the sealing state and the charging state of the grommet 10.

In FIG. 8, the grommet 10 is shown in place in a sealing state within an opening 18 in the base wall 20 of a container. The opening is formed to provide a lip 19. A center opening 22 in the grommet extends through the base 14 and neck 16 up into the crown 12. A set of four through openings 24 in the base 14 are positioned so that when the grommet 10 is in its charging state (see FIG. 9) and the neck 16 is elongated, a charge of propellant can be passed through these holes 24 and the container opening 18 into the container.

As shown in FIG. 9, when liquid propellant or gas under pressure is to be injected into the container through the opening 18 in the container base 20, a gassing head 28 is used.

A pin 26 of the gassing head 28 stretches the neck 16 so that the crown 12 is lifted off of engagement with the container base 20 and the extended neck 16 has a reduced diameter. Propellant can be charged into the container through the gassing head 28, the through openings 24 and around the neck 16 through the container opening 18 into the interior of the container. The grommet 10 is put into the extended or charging position by the stretch pin 26 of a gassing head 28.

The stretch pin has an upper portion 26*a* and a lower portion 26*b*. The upper portion 26*a* fits within the center opening 22 of the neck. It serves to stretch the neck when changing from the FIG. 8 sealing state to the FIG. 9 charging state. The lower portion 26*b* has a diameter slightly greater than the diameter of the opening 22 and engages the base 14 to push a portion of the base into approximately the configuration shown in FIG. 9. The stretching of the neck 18 causes it to become thinner so that, as shown in FIG. 9, propellant can be passed around the outside of the neck through the container opening 18.

What Applicant has observed is that this two diameter stretch pin 26 assures a degree of geometric stability and uniformity in the stretching of the neck thereby assuring that the four through openings 24 will be used in injecting propellant into the base of the container. Applicant is not completely certain as to why this increased stability occurs. But Applicant has observed that a preferred stretch pin has the two diameters indicated in the FIGs. However, a stretch pin of a single diameter can be used.

In one embodiment used with the grommet 10 having the dimensions set forth herein, the upper portion 26*a* has a length of about 150 mils. The lower portion 26*b* has a length of about 170 mils. The lower portion 26*b* has a diameter of 130 mils whereas the upper portion 26*a* has a diameter of 62 mils. It is preferable that these stretch pins have slightly rounded corners to make sure that the engagement with the material of the grommet minimizes the possibility of puncturing the grommet.

After the propellant charge has been injected into the container, the gassing head with the stretch pin 26 is removed and the resilient neck 16 retracts bringing the crown 12 down to engage the container wall 20 at the lip 19 on the bottom of the container, as shown in FIG. 8. The lip 19 of the bottom wall 20 is gripped by an interference fit between the lip 19 and the gap between base 14 and crown 12. This sealing relationship is further enforced by virtue of the pressure inside the container applied to the outer surface of the crown 12.

The neck 16 diameter, when relaxed from the charging state to the sealing state increases to fit the lip 19 so that a second sealing zone is created.

The annular corner 30 (see FIG. 3) between the crown base 12*a* and the neck 16 surface has a curvature that creates an improved sealing engagement by an interference fit contact between the corner of the container wall lip 19 and the grommet corner 30. This creates a third sealing zone. The radius of curvature of the corner 30 in the embodiment shown is small, only four (4) mils.

Figure 10:
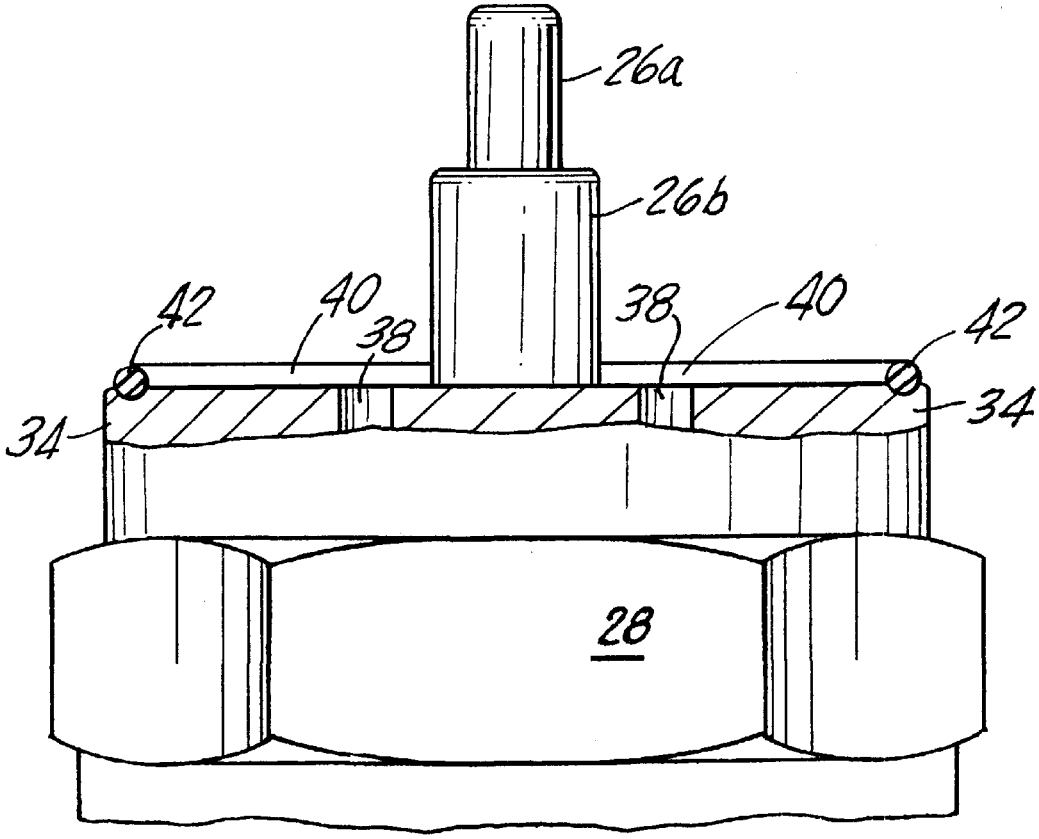
FIG. 10 is a partial elevational and partial sectional view of the gassing head 28 shown in FIG. 9.

A gassing head 28 (see FIGS. 9 and 10) is used during the process of injecting propellant into the container. The gassing head 28 includes an annular outer portion 34, an O-ring 42, a central zone 40 and a set of four gassing ports 38. The center zone 40 provides a manifold space so that gas under pressure injected through ports 40 communicates through space 40 with the base openings 24 and thus into the container.

Applicant has not been able to determine the precise configuration of the grommet portions during the charging state in which the neck 16 is appreciably stretched or the sealing state in which the neck 16 is stretched a lesser amount. It appears that in both states, the base 14 of the grommet is partially pulled into the zone defined by the lip 19 of the container opening. Indeed, the base 14 can be observed to have a concave surface 14*a* in those two states. Thus, in the sealing state, the neck portion 16 stretches part of the way and serves to pull a portion of the base 14 into the zone defined by the lip 19 of the container opening. The neck 16 in the sealing state appears to retain an interference fit sealing relationship of some degree with the lip 19 of the container opening. The stretching of the neck serves to pull the lower surface 12*a* of the crown 12 down into a tight sealing relationship with the interior surface of the bottom of the container. The crown sealing coupled with the sealing at the corner 30 together with a sealing relationship between neck 14 and lip 19 has been observed to provide and maintain an effective seal so as to assure appropriate shelf life for the container involved.

A preferred gassing head (see FIGS. 9 and 10) has an annular outer portion 34 with an O-ring 42 that engages the base wall 20 of the container. The O-ring 42 provides a center zone 40 that is forty to fifty mils deep so as to provide a manifold zone 40 between the four gassing head ports 38 and the four through openings 24 in the base 14 of the grommet. The zone 40 assures that injected propellant will communicate through the grommet base 14 and thus into the container when the neck 16 has been stretched and reduced in diameter during the charging state as shown in FIG. 9.

Depending on the propellant being used and the pressure involved, a stretch pin 26 may or may not be necessary. Under some circumstances, the pressure of the propellant being injected may be enough to lift the crown 12 upward thereby placing the grommet 10 in its unsealed, charging state.

The stretch pin 26 can be useful to provide venting in connection with a filling procedure where the material to be dispensed is loaded into the top of the container prior to the gassing stage. When product is so loaded, the gassing head 28 is in place and the piston is pushed down in the container or the bag is inflated in the container. In both cases, the air in the zone where propellant is to be later injected has to be vented. It is convenient to do this venting with the grommet 10 in place in the FIG. 9 state.

This grommet design can be used in connection with bag type pressurized dispensing containers as well as piston type pressurized dispensing containers.

As is known in the art, the choice of material for the grommet will depend upon the nature of the propellant with which the grommet comes into contact as it is important that there be no degrading chemical interaction between the grommet material and the propellant.

The grommet may be thermoset molded using buna-N or neoprene or other known materials. The grommet may be injection molded. One injection molded material tested is a thermoplastic polyester elastomer available from DuPont under the trademark Hytrel. Another is Santopreme, a thermoplastic rubber like material available from Advanced Elastomer Systems.

The dimensions of a particular embodiment has been tested and are set forth herein. However, it should be kept in mind that the dimensions of the grommet and of its openings as well as of the gas head and of the stretch pin will vary as a function of a number of parameters. These dimensions will require some experimentation in each environment to obtain optimum results.

The parameters which will affect these dimensions include the resilience of the grommet, the stretchability of the grommet, the pressure at which the propellant is injected through the grommet, the time over which propellant is being injected and the size of the dispensing can.

In one embodiment, the grommet 10 and associated container base opening 22 has the following approximate dimensions. These dimensions are recited in mils; that is, in thousands of an inch. The grommet height is 220 mils; of which the crown height is 156 mils, the neck height in the relaxed state is about 14 mils and the base height is 50 mils. Although the container wall 28 is approximately 15 mils thick, the lip 19 that is gripped between the crown 12 and base 14 is close to 20 mils so that the relaxed neck 16 height of 14 mils is stretched in the sealing state to provide an interference fit based seal. In the embodiment where the container base opening 18 is about 207 mils, the lower surface 12*a* of the crown 12 is about 250 mils in diameter to assure that the crown operates as an effective seal in the sealing state. In that embodiment, the base 14 diameter of the grommet is about 325 to 330 mils. The grommet neck 16 is about 213 mils in diameter to provide a sealing fit between the neck and the container opening 18. The annular corner 30 has a radius of curvature of four (4) mils and provides an interference fit seal between the corner 30 and an edge of the lip 19.

The central opening 22 of the grommet is approximately 70 mils and the diameter of the upper portion 26*a* of the stretch pin is approximately between 60 and 65 mils. The diameter of the through openings 24 in the base 14 are approximately 45 mils. When the stretch pin 26 is used, the crown 12 is lifted by about 80 mils and the neck diameter decreases so that it is about 180 mils along a portion of its length.

While the foregoing descriptions and drawings represent a presently preferred embodiment of the invention, it should be understood that those skilled in the art will be able to make changes and modifications to those embodiments without departing from the teachings of the invention and the scope of the claims.

What is claimed is:

1. A grommet for sealing the opening in a pressurized dispensing container, through which opening a propellant charge is injected into the container, comprising:

a base for engaging the outer surface of the container opening through which propellant charge is provided, a crown having a lower surface for engaging the lip of the container opening to provide a sealing engagement, a resilient stretchable neck connecting said base and said crown, said neck having a relaxed state in which it has a diameter greater than the diameter of the lip and a height substantially less than the height of the lip, whereby mounting of said grommet in the lip causes engagement of said crown, said base and said neck with the container lip to provide a sealing relationship between grommet and lip, said base having at least one through opening positioned to be in communication with said neck of said grommet, said grommet having a sealing state and a charging state, said resilient neck in said grommet charging state being stretched to decrease the neck diameter to less than the diameter of the lip of the container opening and to hold said crown above the lip of the container opening so that propellant charge can be passed through said through opening of said base and into the container, said resilient neck in said grommet sealing state being retracted to provide a seal between grommet and lip.

2. The grommet of claim 1 further comprising:

a corner zone at the transition between said lower surface of said crown and said neck configured to provide a sealing engagement between said curved corner and the edge of the lip of the container opening.

3. The grommet of claim 2 wherein: said grommet in said sealing state provides a first sealing engagement between said crown and the upper end of the lip of the container opening, a second sealing engagement between said neck and the side of the lip of the container opening as well as said third sealing engagement between said curved corner and the edge of the lip of the container opening.

4. The grommet of claim 3 having a center opening that extends through said base and said neck to facilitate stretching said neck during said charging state of said grommet and to permit the insertion of a pin to effect said stretching.

5. The grommet of claim 4 wherein: said first, second and third engagements are continuous with one another.

6. The grommet of claim 4 wherein: said corner zone is a curved surface.

7. The grommet of claim 3 wherein: said first, second and third engagements are continuous with one another.

8. The grommet of claim 3 wherein: said base has multiple through openings, each of said through openings being in communication with said neck when the grommet is in said charging state.

9. The grommet of claim 3 wherein: said corner zone is a curved surface.

10. The grommet of claim 2 having a center opening that extends through said base and said neck to facilitate stretching said neck during said charging state of said grommet and to permit the insertion of a pin to effect said stretching.

11. The grommet of claim 2 wherein: said first, second and third engagements are continuous with one another.

12. The grommet of claim 2 wherein: said base has multiple through openings, each of said through openings being in communication with said neck when the grommet is in said charging state.

13. The grommet of claim 2 wherein: said corner zone is a curved surface.

14. The grommet of claim 1 having a center opening that extends through said base and said neck to facilitate stretching said neck during said charging state of said grommet and to permit the insertion of a pin to effect said stretching.

15. The grommet of claim 14 wherein: said base has multiple through openings, each of said through openings being in communication with said neck when the grommet is in said charging state.

16. The grommet of claim 1 wherein: said base has multiple through openings, each of said through openings being in communication with said neck when the grommet is in said charging state.

17. The method of charging a pressurized dispensing container with propellant comprising the steps of:

inserting a grommet having a sealing crown, a base with charging holes and a sealing neck connecting said crown and base into a charging opening in the container, said neck having a larger cross-sectional area than said charging opening, extending said neck to lift said sealing crown from its sealing state and to reduce the diameter of said neck to less than that of the container opening, charging the container through said charging holes of said grommet base while said neck is extended, terminating said step of extending said grommet.

* * * * *